United States Patent [19]

Wolf

[11] Patent Number: 4,470,800

[45] Date of Patent: Sep. 11, 1984

[54] CERAMIC BURNER FOR A HOT BLAST STOVE

[75] Inventor: Georg Wolf, Cologne, Fed. Rep. of Germany

[73] Assignee: Martin & Pagenstecher GmbH, Cologne, Fed. Rep. of Germany

[21] Appl. No.: 449,927

[22] Filed: Dec. 15, 1982

[30] Foreign Application Priority Data

Dec. 21, 1981 [DE] Fed. Rep. of Germany ..... 3150574

[51] Int. Cl.[3] ..... F23Q 9/00

[52] U.S. Cl. ..... 431/285; 431/174; 431/180; 432/217

[58] Field of Search ..... 431/170, 178, 179, 180, 431/181, 285, 353, 354, 174; 266/197; 239/418, 424.5; 432/214, 217, 218

[56] References Cited

U.S. PATENT DOCUMENTS

| | | | |
|---|---|---|---|
| 3,219,096 | 11/1965 | Goeke et al. | 431/354 |
| 3,837,793 | 9/1974 | Lucieer et al. | 432/217 |
| 4,169,700 | 10/1979 | Yoshioka et al. | 431/285 X |
| 4,259,064 | 3/1981 | Laux et al. | 431/170 X |

*Primary Examiner*—Samuel Scott
*Assistant Examiner*—Margaret A. Focarino
*Attorney, Agent, or Firm*—Sprung Horn Kramer & Woods

[57] ABSTRACT

There is disclosed in a ceramic burner comprising a base, a crown disposed on an opposing end to said base and therebetween a housing defining a combustion chamber, a first conduit entering said housing and communicating therein with a gas chamber in turn communicating with a gas passage running longitudinally therethrough, a second conduit entering said housing and communicating therein with an air chamber in turn communicating with an air passage running therethrough, said gas passage and said air passage juxtaposed to one another, each having an elongated cross section, said gas passage and said air passage being vertically supported from one another, said gas passage and said air passage being in communication with said crown the improvement wherein between said gas passage and said air passage there is disposed at least one gas slot and at least one air slot extending from said base to said crown, said gas slot and said air slot being closed off from said gas passage, said air passage, said gas chamber and said air chamber, said gas slot connected to a third conduit for supplying gas thereto, said air slot being connected to a fourth conduit for supplying air thereto, said third and fourth conduits each comprising means for regulating the amount of gaseous material passed therethrough.

5 Claims, 8 Drawing Figures

CERAMIC BURNER FOR A HOT BLAST STOVE

BACKGROUND OF THE INVENTION

1. Field of the Invention

This invention relates to a ceramic burner for the combustion of a gas/air mixture. Such burner can be located in the lower portion of a combustion chamber of a hot blast stove. The burner possesses inlet pipe-sections for gas and combustion air, which open into the combustion chamber, together with associated gas and air chambers, which merge into gas-slots and air-slots having an elongated horizontal cross-section, these slots being located one besides another, running vertically, and being separated one from another. Above the gas- and air-slots, the two media are mixed in one or more distributor-courses, and are burnt at the crown of the burner.

2. Discussion of Prior Art

Ceramic burners of this generic type are known. See for example, German Auslegeschrift No. 1,290,285 and German Offenlegungsschrift No. 1,526,027. They are employed, in particular, in hot blast stoves for blast furnaces, in order to generate the hot blast which is required for operating the blast furnace. These burners enable effective and thorough mixing of the media (gases) to be achieved, and enable the media to be uniformly distributed. A starting-up procedure is necessary when bringing a hot blast stove into service in order to heat up the cold blast stove. Due to a limited range of control, this starting-up procedure cannot be carried out with the known ceramic burners. A cold hot blast stove, which is equipped with a ceramic burner of the type described above, must accordingly be started-up with the aid of a separate auxiliary burner which is generally a mechanically operated burner with an appropriate control range. After reaching the starting-up temperature of approximately 500°–700° C. the auxiliary burner is removed. The further heating up of the hot blast stove can then be continued by means of the built-in ceramic burner.

In the event of plant shutdowns lasting for less than three months, it is advantageous to avoid allowing the hot blast stove to completely cool down to the cold state. Instead, it is maintained at a temperature of approximately 600° C. The ceramic burners of the known type are likewise unsuitable for carrying out this so-called "standby" operation. This applies, in particular, if, in the event of a plant shutdown, the supply of lean gas (blast furnace waste gas) from the blast furnace also ceases, and only rich gas (natural gas, coke-oven gas) is available for the "stand-by" operation. Up to the present time, it was accordingly necessary to employ an additional temperature-maintaining burner for the "stand-by" operation, the erection and dismantling of this burner representing a considerable expense.

It is an object of this invention, therefore, to provide a ceramic burner which is unencumbered by the drawbacks of the previous burners, in terms of their controllability, and avoids the disadvantages of the known burner in respect of their inability to economically function during a "stand-by" operation, especially with regard to the erection and dismantling of separate auxiliary burners.

SUMMARY OF THE INVENTION

This object is achieved, in a ceramic burner of the type initially described, wherein at least one gas-slot, and at least one air-slot, leading from the base of the burner, up to the crown of the burner, are located between the gas-passages and the air-passages, these slots being closed-off with respect to these passages and with respect to the gas-and air-chambers, into which slots separated supply lines, under the base of the burner, additionally feed in gas and air respectively, these lines being capable of being shut off.

The advantage which is obtained by means of the invention resides, in particular, in the possibility of controlling the ceramic burner section-by-section, as a result of which, in particular, the installation of separate auxiliary burners becomes unnecessary. The auxiliary burner is integrated within the main burner.

The integrated ceramic auxiliary burner enables the hot blast stove to be heated up, in a linear manner, from 20° to 1100° C. From 0.5–5% of the total burner output, when operating on lean gas, gas and air are admitted, in each case, to only one slot, via the separated gas and air supply lines, in which measurements and control actions are carried out.

Furthermore, the integrated ceramic auxiliary burner enables the hot blast stove to be operated in the energy-saving "stand-by" mode, in the temperature range above 600° C. either with lean gas or with rich gas. When operating on rich gas, in the range below 5% of the total output, the rich gas and the quantity of combustion air required for perfect combustion are likewise conveyed via the ceramic auxiliary burner. Excessive quantities of air are controlled, as a function of temperature, by means of the air-slots of the main burner, it being possible, when doing so, to operate with an excess of air amounting to as much as 150%.

Fluctuations in the gas pressure, especially when operating on lean gas, can be smoothed out by means of a control element, operating automatically and set to the required flow-rate value.

In normal operation, the ceramic auxiliary burner functions together with the main burner, as a unit. The integrated auxiliary burner can also take over the task of an ignition burner.

Further advantages result from the fact that, because the gas and air slots are led beyond the vertical central plane of the combustion chamber and are thereby elongated, the cross-section at the narrowest point in the burner becomes larger by up to 30%. If cold gas and cold combustion air are used, the hot blast stove can be operated at a lower blower power. If the combustion air is preheated, the enlarged cross-section of the burner thus permits operation at the same pressure upstream of the blowers, that is to say, there is no need to employ larger blowers.

Effective and thorough gas/air mixing in the main and auxiliary burners results from the alternating arrangement of the gas and air slots, and from the integration of the gas and air slots of the main burner with those of the auxiliary burner.

In ceramic burners, according to the invention, the walls and lateral closures of the gas-slots, and of the air-slot are preferably constructed from shaped bricks and plates which are made of ceramic and are arranged one on top of another. Tongue-and-groove elements and/or bump-and-cavity elements are provided in order to effect the connection of these bricks and plates, one to another. In a further embodiment, shaped bricks, possessing projections on both sides, are located in the walls of the gas-slots and of the air-slots, in a uniformly distributed manner and the projections on adjacent walls are, for the purpose of support, in mutual contact.

The ceramic burner, according to the invention, can be installed in either a hot blast stove with an externally-located combustion chamber, or in a hot blast stove with an internally-located combustion chamber.

BRIEF DESCRIPTION OF DRAWINGS

In the text below, the invention is explained in more detail by reference to two illustrative embodiments, and by reference to the diagrammatic drawings, in which.

DESCRIPTION OF SPECIFIC EMBODIMENTS

Figure 1:
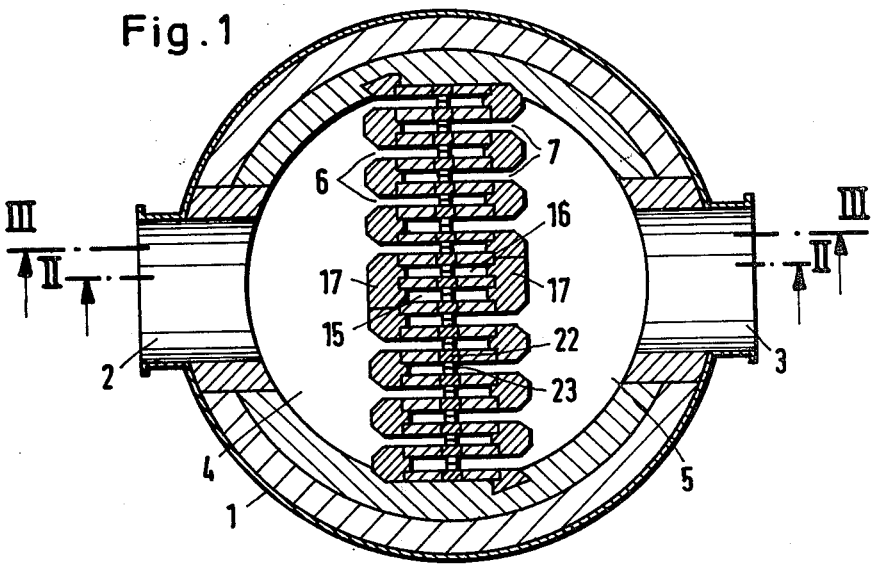
FIG. 1 shows a horizontal cross-section through a ceramic burner according to the invention, conforming to the line I—I in FIG. 2, this burner being installed in the externally-located combustion chamber of a hot blast stove.
Figure 2:
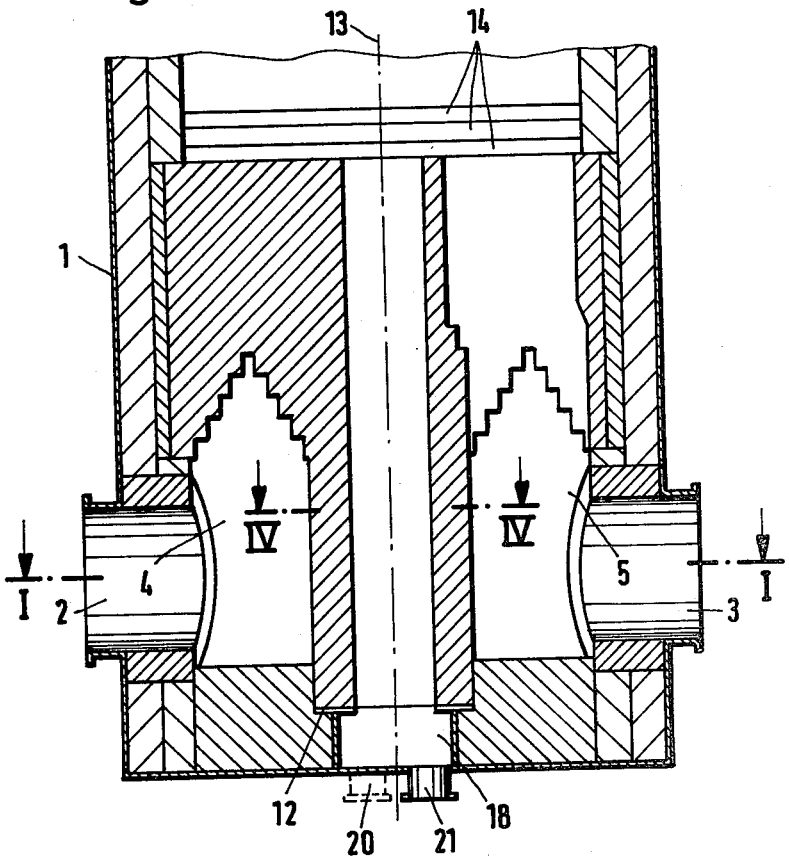
FIG. 2 shows a peripendicular cross-section through the ceramic burner according to FIG. 1, following the line II—II.
Figure 3:
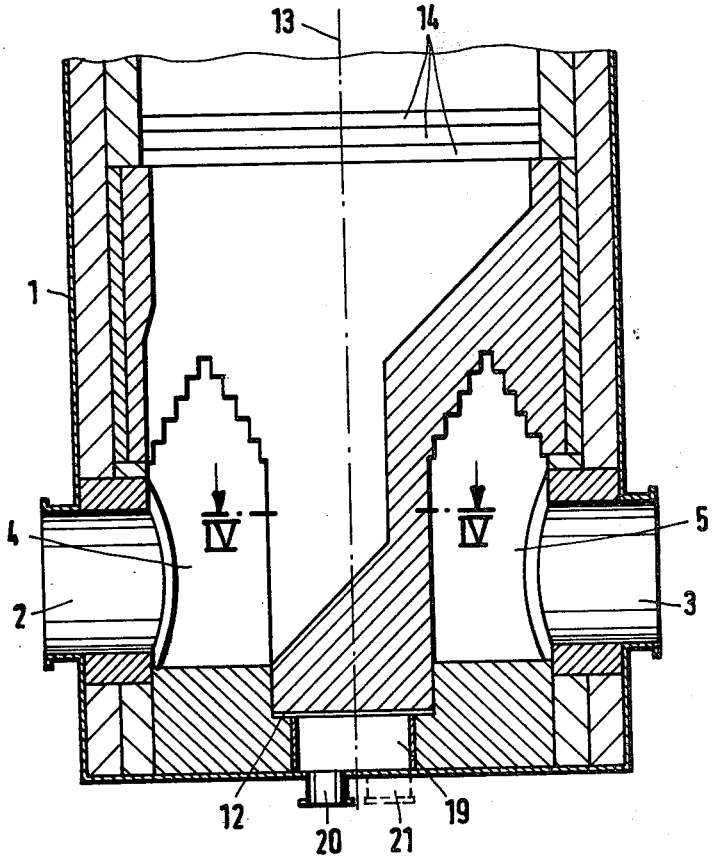
FIG. 3 shows a perpendicular cross-section through the ceramic burner according to FIG. 1, following the line III—III.

The burner, according to the invention, represented in FIGS. 1 to 3, is installed in the lower portion of an externally-located hot blast stove combustion chamber 1, this chamber possessing a circular cross-section. On opposite sides of the combustion chamber, inlet pipe-sections 2,3, for gas and combustion air respectively, open into the gas chamber 4 and the air chamber 5, respectively, these chambers being located in the interior of the combustion chamber. Shaped bricks and/or shaped plates, made of ceramic, are arranged in the combustion chamber, besides and above one another, in such a manner that they form gas-slots 6 and air-slots 7, these slots being located one beside another, running vertically and closed-off with respect to one another, the gas passage 6 communicating, in each case, only with the gas chamber 4, and the air passage 7 communicating only with the air chamber 5.

Figure 4:
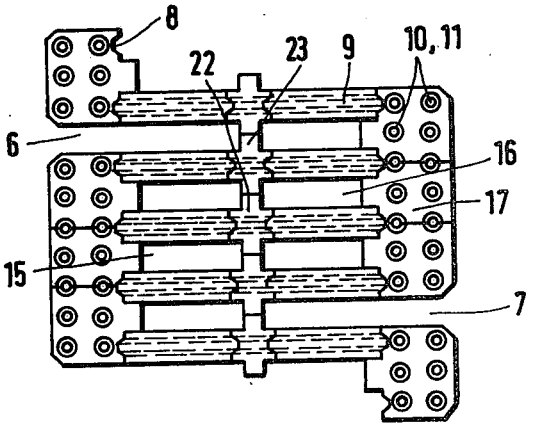
FIG. 4 shows a horizontal cross-section following the line IV—IV in FIGS. 2 and 3.

As represented in FIG. 4, in a partial view, the shaped ceramic bricks and plates are connected, one to another, by means of tongue-and-groove elements 8, 9 and/or by means of bump-and-cavity elements 10,11.

Gas slots 6 and the air slot 7, have elongated horizontal cross-sections. The walls which define such passages 6 and 7 rest on the base 12 of the burner and extend, from both sides, beyond the central plane 13 of the combustion chamber. The extension beyond the central plane is limited in the lower portion of the combustion chamber, due to the gas and air chambers 4, 5 which are installed within this lower portion. Above the gas and air chambers, the breadth of the passages 6,7 gradually expands, to the entire diameter of the combustion chamber, as shown, in particular, by FIG. 3, as a result of which the gas and air chambers, 4 and 5 respectively, are partitioned-off from the combustion chamber. The distributor-courses of the crown 14 of the burner are located above the gas passages 6 and the air passages 7.

As FIG. 1 shows, a gas-slot 15 and an air-slot 16 are closed-off with respect to the gas and air chambers 4,5, and with respect to the gas passages 6 and air passages 7, by means of shaped bricks 17. In this manner, two separate gas and air slots are formed, extending from the base 12 of the burner up to the distributor-courses of the crown 14 of the burner.

As FIGS. 2 and 3 show, a gas-box 18 and an air-box 19 are located under the base 12 of the burner, these boxes communicating, respectively, with the separate gas-slot 15 and the separate air-slot 16. and being supplied with gas and air for the integrated auxiliary burner by separate gas and air supply-lines 20,21, in a manner permitting turning-on and shutting-off, as well as control.

In order to support the walls forming the gas and air slots, one against another, shaped bricks 22 are located on the walls in a uniformly distributed manner, as shown, in particular, by FIG. 4, these bricks possessing, on both sides, projections 23 which extend into the passages 6 and 7. The projections on adjacent walls are in mutual contact and thereby give the burner adequate stability.

Figure 5:
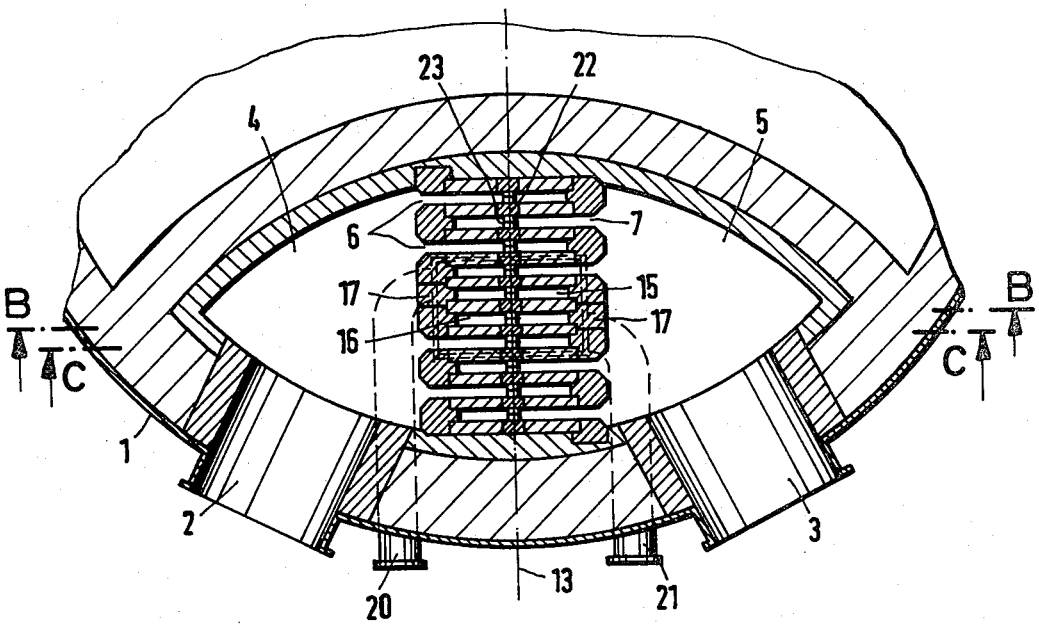
FIG. 5 shows a horizontal cross-section through a ceramic burner, according to the invention, conforming to the line A—A in FIG. 6, this burner being installed in the internally-located combustion chamber of a hot blast stove.
Figure 6:
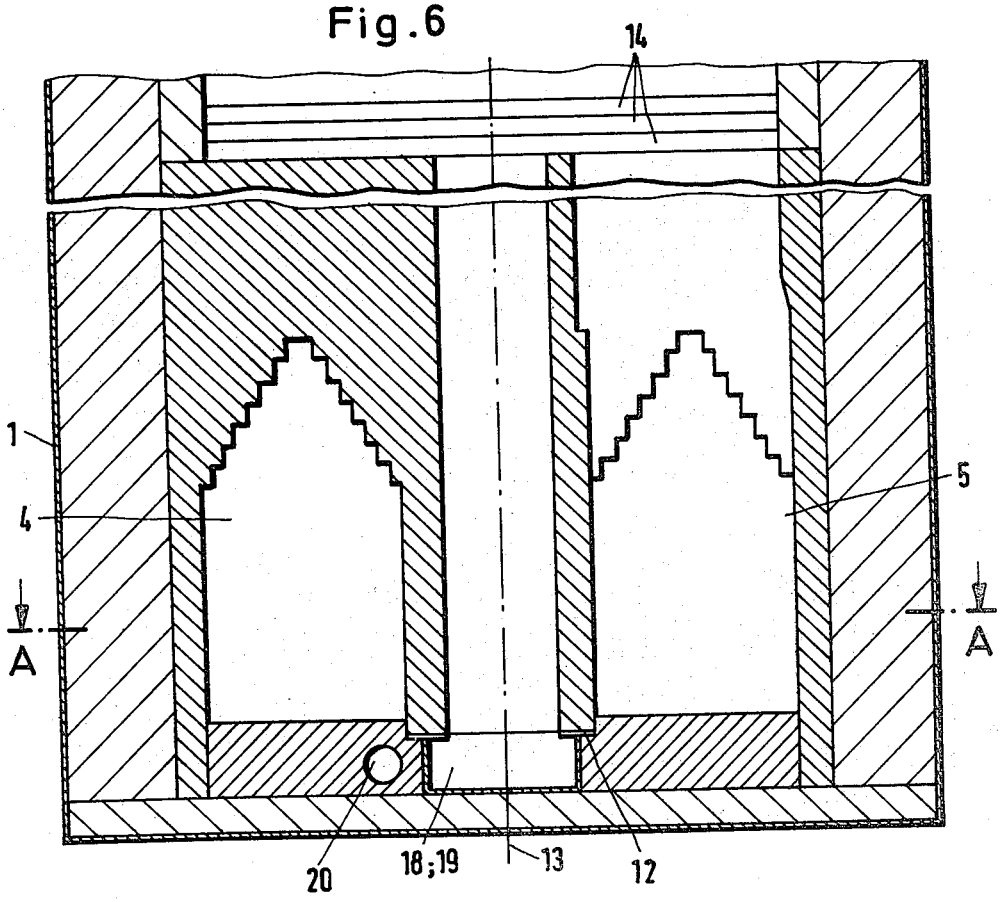
FIG. 6 shows a perpendicular cross-section through the ceramic burner according to FIG. 5, following the line B—B.
Figure 7:
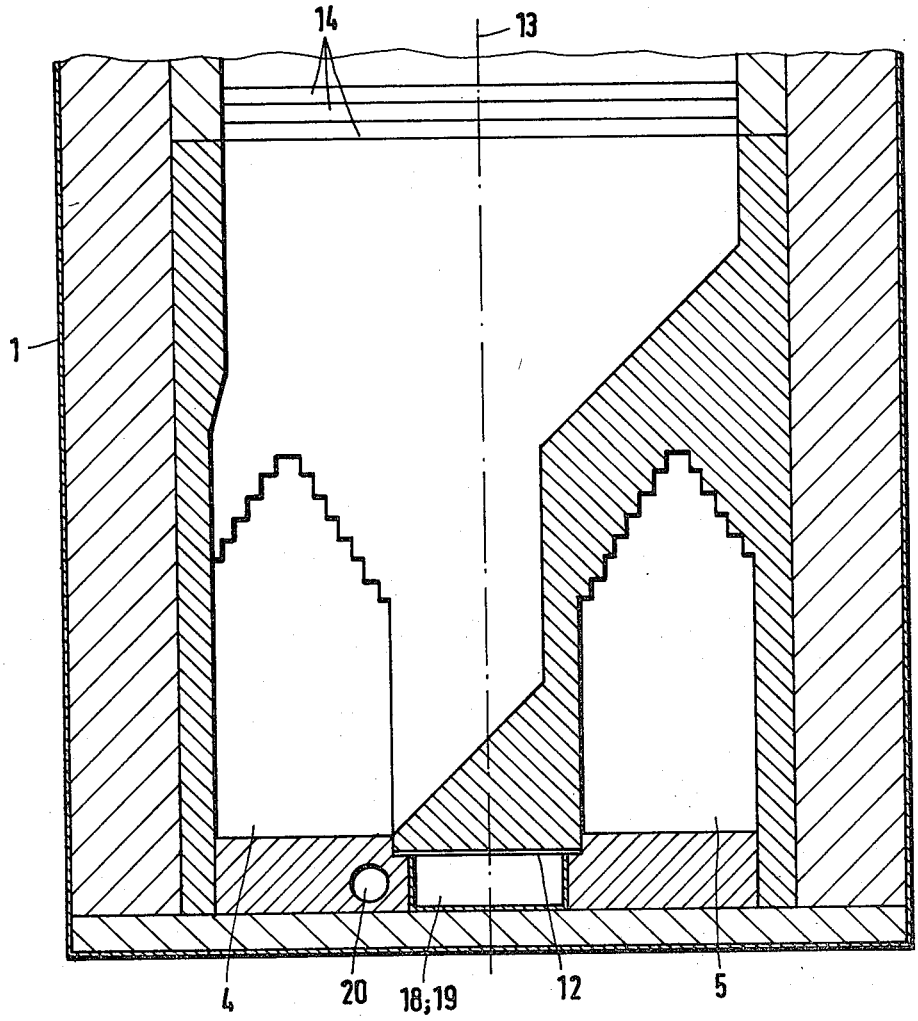
FIG. 7 shows a perpendicular cross-section through the ceramic burner according to FIG. 5, following the line C—C.

The burner, according to the invention, represented in FIGS. 5 to 7 is installed in the lower portion of an internally-located combustion chamber 1 of a hot blast stove, this combustion chamber having an oval cross-section. On both sides of the central plane of the short axis 13 of the combustion-chamber cross-section, inlet pipe-sections 2,3, for gas and combustion air, open into the combustion chamber, these pipe-sections being contiguous, in the interior of the combustion chamber, with, respectively, a gas chamber 4 and an air chamber 5. The gas passages 6 and air passages 7, which possess an elongated horizontal cross-section, extend down to the base 12 of the burner and their open cross-section extends, in their horizontal breadth, beyond the central plane of the short axis 13 of the oval cross-section of the combustion chamber.

In this embodiment as well, the breadth in the lower portion of the combustion chamber is limited, on account of the gas and air chambers 4,5 which are necessary. Above the gas and air chambers, the breadth gradually expands to the entire cross-section of the combustion chamber, as shown, in particular, by FIG. 7. The distributor-courses of the crown of the burner are again marked 14, while the separate gas and air slots are marked 15 and 16, and the shaped bricks for closing-off the slots 15 and 16 are marked 17.

Figure 8:
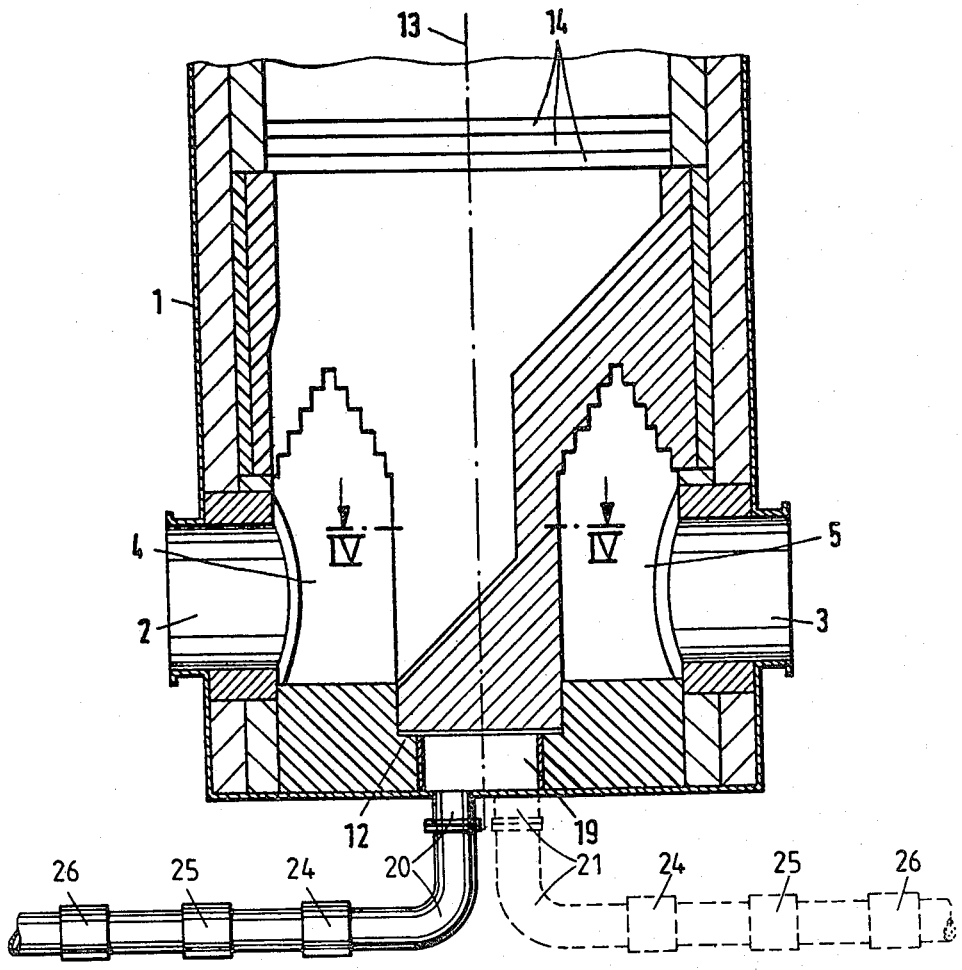
FIG. 8 is a view similar to FIG. 3 showing the 3rd and 4th conduits for supplying gas each of which is equipped with means for regulating the amount of gaseous material path therethrough.

As FIGS. 6 and 7 show, an air-box 19 is located under the base 12 of the burner, as is a gas-box 18, which is not represented, but lies behind the air-box, these boxes respectively communicating with the separate gas and air slots 15,16 of the integrated auxiliary burner, and being supplied with gas and air by separate gas and air supply lines 20,21, which are represented in FIG. 5, in a manner permitting turning-on, shutting-off, and control. FIG. 8 shows the 3rd and 4th conduits in which in each of said conduits there is a control element 24, a flow measuring device 25 and a shut-off element 26. One of these lines is connected to a gas supply line 20 while the other is connected to an air supply line 21.

What is claimed is:

1. In a ceramic burner comprising a base, a crown disposed on an opposing end to said base and therebetween a housing defining a combustion chamber, a first conduit entering said housing and communicating therein with a gas chamber in turn communicating with a gas passage running longitudinally therethrough, a second conduit entering said housing and communicating therein with an air chamber in turn communicating with an air passage running therethrough, said gas passage and said air passage juxtaposed to one another, each having an elongated cross section, said gas passage and said air passage being vertically supported from one another, said gas passage and said air passage being in communication with said crown the improvement wherein between said gas passage and said air passage there is disposed at least one gas slot and at least one air slot extending from said base to said crown, said gas slot and said air slot being closed off from said gas passage, said air passage, said gas chamber and said air chamber, said gas slot connected to a third conduit for supplying gas thereto, said air slot being connected to a fourth conduit for supplying air thereto, said third and fourth conduits each comprising means for regulating the amount of gaseous material passed therethrough.

2. A ceramic burner according to claim 1, wherein said gas passage and said air passage are separated by a wall which rests on the base of said burner within which wall are said air slot and said gas slot said wall extending toward said crown and in its cross sectional plane following a meander-shaped course and running on both sides beyond the vertical central plane of said combustion chamber.

3. A ceramic burner according to claim 1, wherein said burner comprises a plurality of gas slots and air slots in communication with said third and fourth conduit respectively and said air passage and said gas passage are in the form of a plurality of slots which are arranged in an alternating sequence on both sides of said gas slots and said air slots.

4. A ceramic burner according to claim 1, wherein said gas slots and air slots are defined by vertical walls and lateral closures, said vertical walls and lateral closures made of shaped ceramic bricks or plates arranged one on top of another and connected one to another by means of a tongue-and-groove arrangement and/or by means of a bump-and-cavity assembly.

5. A ceramic burner according to claim 1 wherein said gas slot and said air slot are defined by vertical walls and lateral closures, said vertical walls formed by abutting projections from a wall separating a gas passage or slot from an air passage or slot, said projections distributed in a uniform manner.

* * * * *